US005442897A

United States Patent [19]

Hinzmann et al.

[11] Patent Number: 5,442,897

[45] Date of Patent: Aug. 22, 1995

[54] METHOD OF AND APPARATUS FOR MAKING TUBULAR ENVELOPES

[75] Inventors: Alfred Hinzmann, Weems; Peter Preisner, Quinton; Timour Shu; Wojciech Drewnowski, both of Richmond, all of Va.

[73] Assignee: Hauni Richmond, Inc., Richmond, Va.

[21] Appl. No.: 132,506

[22] Filed: Oct. 5, 1993

[51] Int. Cl.[6] ..... B65B 5/02; B65B 9/00; B65B 51/26; B65B 61/12

[52] U.S. Cl. ..... 53/449; 53/450; 53/452; 53/172; 53/550; 53/563; 414/287; 414/288; 414/289; 414/302; 414/308; 414/933

[58] Field of Search ..... 53/563, 550, 252, 450, 53/449, 172, 451, 551, 552, 452; 493/287, 288, 303, 308, 289, 302, 933; 156/164

[56] References Cited

U.S. PATENT DOCUMENTS

| | | | |
|---|---|---|---|
| 1,350,845 | 8/1920 | Scardone | 53/172 X |
| 2,350,132 | 5/1944 | Rohdin | 493/933 X |
| 2,935,919 | 5/1960 | O'Neill | 493/287 |
| 3,236,021 | 2/1966 | Wagner et al. | 53/563 X |
| 3,452,505 | 7/1969 | Hoag | 53/563 X |
| 3,623,891 | 11/1971 | Coffey | 53/450 X |
| 3,974,623 | 8/1976 | Bate | 53/252 X |
| 4,123,312 | 10/1978 | Schmid et al. | 493/308 X |
| 4,430,844 | 2/1984 | James | 53/550 X |
| 4,617,683 | 10/1986 | Christoff | 493/302 X |
| 4,620,409 | 11/1986 | McElvy | 53/551 |
| 4,845,922 | 7/1989 | Sweere | 53/551 X |
| 5,050,368 | 9/1991 | Noh | 53/450 X |
| 5,185,984 | 2/1993 | Tisma | 53/252 |
| 5,273,605 | 12/1993 | Mitchell | 493/303 X |
| 5,317,849 | 7/1994 | Sauter | 53/563 X |

*Primary Examiner*—Horace M. Culver
*Attorney, Agent, or Firm*—Darby & Darby

[57] ABSTRACT

A continuous web of wrapping material for catamenial tampons or other commodities is advanced lengthwise first through a station where it is acted upon by a perforating knife to weaken longitudinally spaced-apart portions of the web transversely of the direction of advancement. The web is thereupon converted into a continuous tubular body and the leader of the tubular body is engaged by a pair of rolls which pull the leader in the direction of lengthwise advancement of the web in order to break the material of the web along successive weakened portions. The thus obtained discrete tubular envelopes are moved sideways, one end portion of each envelope is closed, a commodity is introduced through the other end portion, and the other end portion is closed to confine the commodity at both ends. Such mode of making tubular envelopes ensures that the material of the web is not wasted at all and that the envelopes need not be stored prior to reception of commodities.

40 Claims, 4 Drawing Sheets

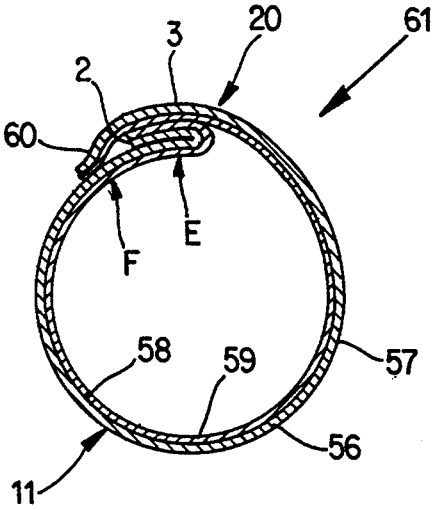
FIG. 3
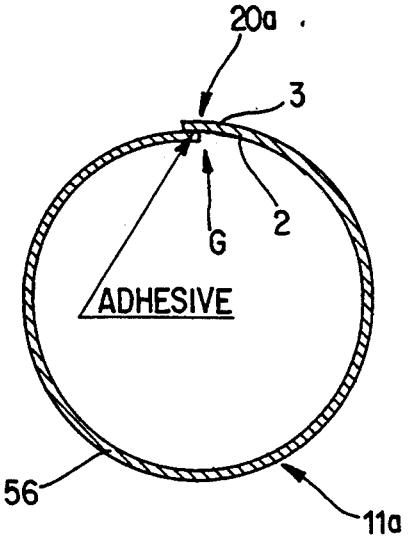
FIG. 4
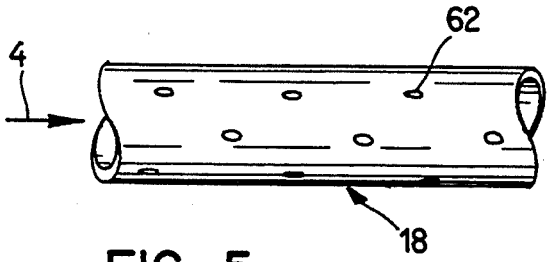
FIG. 5
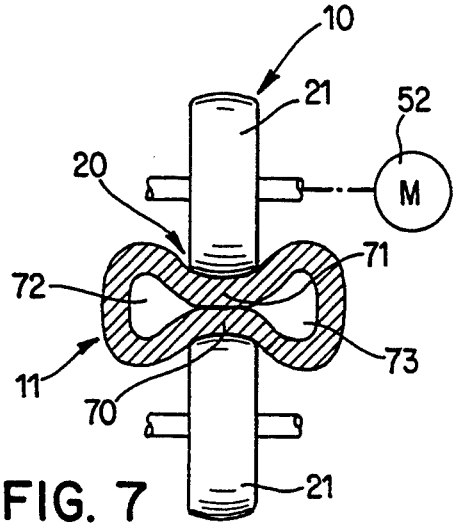
FIG. 7
FIG. 6
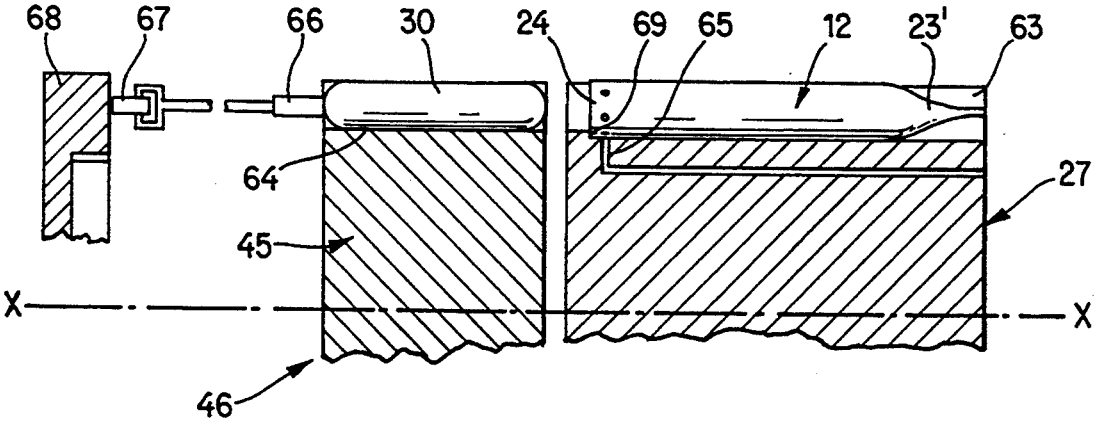

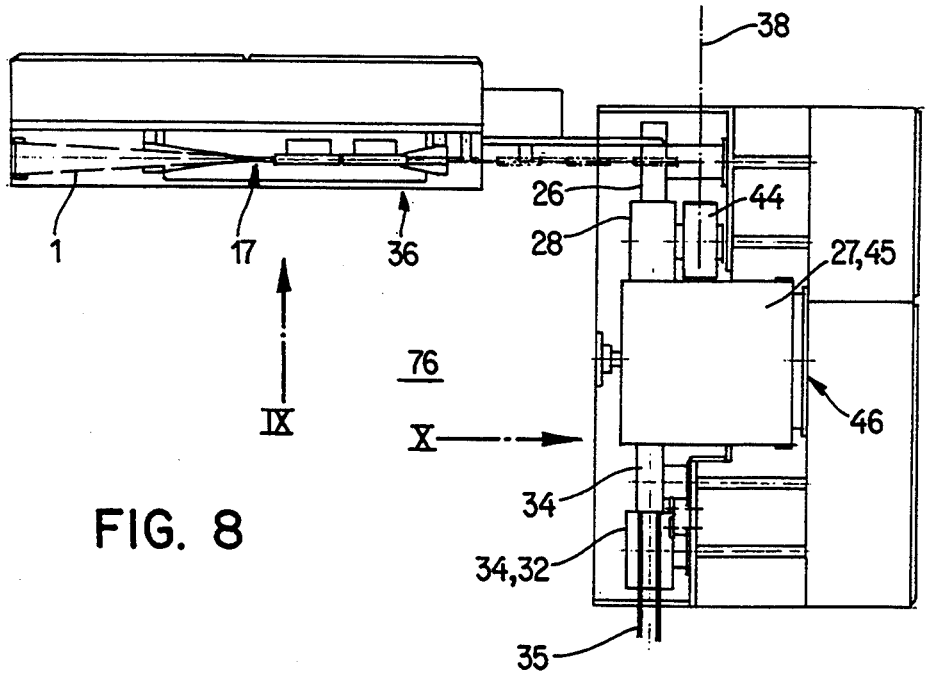
FIG. 8
FIG. 9
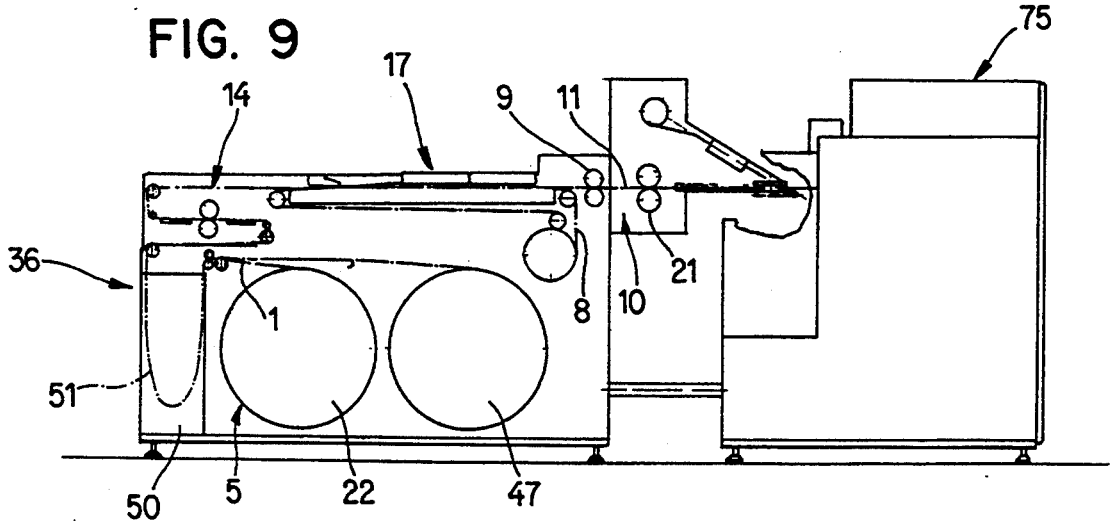
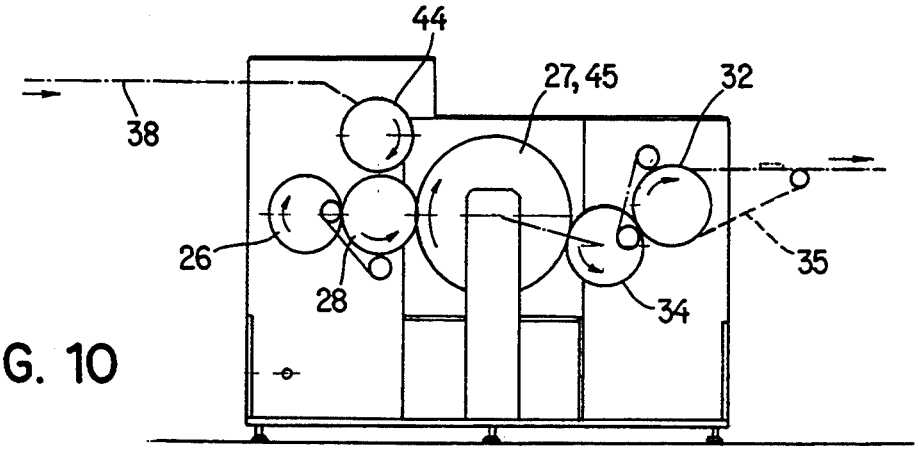
FIG. 10

METHOD OF AND APPARATUS FOR MAKING TUBULAR ENVELOPES

BACKGROUND OF THE INVENTION

The invention relates to improvements in methods of and in apparatus for producing discrete tubular envelopes or wrappers of finite length, e.g., for storage of commodities in the form of rods, cylinders, bars or the like. Typical examples of commodities which can be confined in tubular envelopes or wrappers of the type adapted to be produced in accordance with the present invention are catamenial tampons. However, the envelopes or wrappers (hereinafter called tubes for short) which can be obtained in accordance with the method and by resorting to the apparatus of the present invention can be employed with equal or similar advantage for temporary or long-lasting storage or confinement of many other types of commodities in the form of grains, rods, bars (such as candy bars), pellets, cylinders and/or others.

It is known to confine various types of commodities in tubular envelopes, normally in such a way that the material of which the envelopes are made is draped around the commodities to be confined therein. For example, a continuous cigar, cigarillo or cigarette rod can be obtained by forming a continuous rod-like filler of natural, synthetic and/or reconstituted tobacco and by draping the filler into a running web of cigarette paper or other suitable wrapping material. The thus obtained continuous cigar, cigarillo or cigarette rod is thereupon severed at regular intervals by a so-called cutoff to yield a file or row of successive cigars, cigarillos or cigarettes of unit length or multiple unit length. Filter rod sections for attachment to plain cigarettes, cigars or cigarillos can be produced in a similar way by draping a web of wrapping material around a running rod-like filler of filter material for tobacco smoke.

Entirely different problems arise if discrete commodities, such as catamenial tampons or other feminine hygiene products, are to be individually confined in prefabricated envelopes, e.g., in tubes consisting of or containing paper, metallic foil or plastic material. This necessitates the making of large numbers of tubes and the insertion of one or more commodities into each prefabricated tube. It is further necessary to close each tube at one end or at both ends upon introduction of one or more commodities into its interior. The making of large numbers of tubes, the introduction of commodities into such tubes, and the closing of end portions of filled tubes (especially airtight closing) involve the utilization of complex machinery, especially if the tubes are to receive mass-produced commodities so that they must be turned out in large quantities per unit of time. If the tubes are mass-produced in advance of filling with commodities, it is necessary to provide huge storage facilities for temporary storage of tubes prior to advancement to the filling station or stations. Such storage facilities must be provided in addition to those which are necessary for temporary storage of commodities to be introduced into prefabricated tubes.

Another possible procedure would involve the making of tubes directly around the commodities to be confined therein. This is often impossible or impractical because the plant or machine for the making of commodities is or often must or should be located at a distance from the tube making machine or plant. Moreover, the commodities to be wrapped could be of the type requiring some storage for aging or for other purposes prior to confinement in envelopes in the form of tubes or the like.

OBJECTS OF THE INVENTION

An object of the invention is to provide a simple and inexpensive method of making (particularly mass-producing) envelopes (particularly tubular envelopes) for commodities of all kinds, for example, elongated rod-shaped, solid, hollow cylindrical or similar disposable or reusable, edible or non-edible products.

Another object of the invention is to provide a method which can be practiced in a small area to turn out large quantities of envelopes per unit of time.

A further object of the invention is to provide a method which renders it possible to avoid the need for facilities (such as reservoirs or magazines) for temporary storage of large (or even small) quantities of prefabricated envelopes.

An additional object of the invention is to provide a method which can be practiced with equal advantage for the making, especially for mass-production, of smaller or larger, shorter or longer, stronger or weaker, imprinted or plain, transparent, translucent or opaque envelopes.

Still another object of the invention is to provide a method which can be practiced with particular advantage for the making of elongated tubular envelopes for confinement of elongated tubular commodities, such as tampons.

A further object of the invention is to provide a method which renders it possible to avoid any waste of wrapping material and which can be readily practiced in such a way that the rate of making tubular envelopes matches or at least approximates the desired rate of confinement of commodities therein.

Another object of the invention is to provide a novel and improved apparatus for the practice of the above outlined method.

An additional object of the invention is to provide the apparatus with novel and improved means for converting wrapping material into a succession of tubular envelopes or containers for discrete commodities or for groups or sets of two or more commodities.

Still another object of the invention is to provide a novel and improved production line for the making of catamenial tampons.

A further object of the invention is to provide an apparatus which can be readily designed or modified to turn out envelopes for longer or shorter, thicker or thinner, sturdy or sensitive and/or round or polygonal commodities.

Another object of the invention is to provide an apparatus which can turn out envelopes without any waste in wrapping material.

An additional object of the invention is to provide a novel method of and a novel device for converting a running web into a tubular body.

Still another object of the invention is to provide a continuous tubular body of paper or other web material with a novel seam.

A further object of the invention is to provide a novel and improved method of and means for breaking up a tubular body into tubular sections of desired length.

Another object of the invention is to provide a fluid-tight tubular envelope for confinement of hygroscopic commodities.

An additional object of the invention is to provide a novel seal between overlapping marginal portions of a running flexible web which has been converted or which is being converted into a tubular body.

Still another object of the invention is to provide a device which can be used for the making of such novel seal.

SUMMARY OF THE INVENTION

One feature of the present invention resides in the provision of a method of transforming an elongated flexible web (e.g., a web of laminated or adhesive-coated paper, metallic foil, plastic foil or the like) having two longitudinally extending marginal portions into a succession of discrete tubular articles (hereinafter called tubes for short). The improved method comprises the steps of weakening a plurality of longitudinally spaced-apart and substantially transversely extending portions of the web, advancing the web lengthwise along a predetermined path in a predetermined direction, converting the web into a continuous tubular body in a first portion of the elongated path including securing the marginal portions of the web to each other, and subdividing the tubular body into the aforementioned succession of discrete tubes including exerting upon the tubular body a pull in the predetermined direction in a second portion of the path to break the advancing tubular body along successive weakened portions.

The weakening step is or can be carried out in at least one third portion of the elongated path upstream of the second portion or upstream of the first portion of such path. This weakening step can include perforating the longitudinally spaced-apart portions of the web prior to introduction into the predetermined path or during advancement of the web portions to be weakened along the predetermined path. The perforations can be circular holes, elongated slits or slots and/or any other holes which are obtained by removing some material from the web and/or by simply piercing or repeatedly folding the web.

The tubes which are obtained in accordance with the above outlined method each have two spaced-apart end portions, normally open end portions, and the method can further comprise the step of closing at least one end portion of each of the aforementioned succession of tubes downstream of the second portion of the predetermined path. Such method can further comprise the step of introducing commodities into successive discrete tubes downstream of the second portion of the predetermined path. The method can be carried out in such a way that one end portion of each tube is closed downstream of the first portion of the path, the commodities (e.g., in the form of elongated tubular catamenial tampons or other feminine hygiene products) are introduced through the other end portions of the tubes upon completion of the closing step, and the other end portions of the tubes are closed in a subsequent step so that the introduced commodities are confined between the two closed (e.g., closed and sealed) end portions of the respective tubes.

The commodities (e.g., elongated rod-shaped commodities) can be introduced into the respective tubes at any desired location downstream of the first portion of the predetermined path.

If the web consists of or contains heat-sealable and/or pressure-sensitive material, the converting step and/or at least one of the closing steps can include bonding the marginal portions of the web to each other (to form the tubular body) and/or bonding parts of the end portions to each other, e.g., by flattening the end portions with simultaneous application and/or as a result of the application of heat and/or pressure.

The method can further comprise the step of moving successive discrete tubes sidewise or sideways (namely at least substantially at right angles to the predetermined direction) downstream of the second portion of the predetermined path. The step of at least partially filling successive discrete tubes with commodities can take place during sidewise movement of the tubes. One end portion of each tube can be closed (e.g., closed and sealed) not later than in the course of the filling step, and the other end portion of each tube can be closed at any time upon completion of the filling step. As already mentioned above, at least one of the closing steps can include flattening the respective end portions of the tubes.

The subdividing step can include partially flattening longitudinally spaced-apart portions of the tubular body.

The securing step preferably includes fluid-tightly connecting the marginal portions of the web to each other.

A first side of the converted web constitutes an inner side and a second side of the converted web constitutes an outer side of the tubular body. The securing step of the method of transforming such web can include bonding the first sides of the marginal portions of the web to each other to form a fin, and (simultaneously or subsequently) bonding the fin to the outer side of the tubular body.

Alternatively, the securing step can include applying a film of adhesive (e.g., a hot melt or polyvinyl acetate glue) to one side of one of the marginal portions and bonding the other side of the other marginal portion to the one side of the one marginal portion.

The first side of the web can be provided with a fluid-impermeable layer of heat-sealable material. The securing step of the method of transforming such web can include heat sealing one side of one of the two marginal portions to the other side of the other marginal portion of the web.

The method can also comprise the steps of establishing and maintaining a source of convoluted web in a further portion of the path upstream of the first portion. The advancing step then comprises drawing the web from such source, and the method can further comprise the step of establishing a supply of web in the path, e.g., by looping the web between the source and the first portion of the path.

Another feature of the present invention resides in the provision of an apparatus for transforming an elongated flexible web having two longitudinally extending marginal portions into a series of discrete tubes. The apparatus comprises means for weakening a plurality of longitudinally spaced apart and substantially transversely extending portions of the elongated web, means for advancing the web lengthwise along a predetermined path in a predetermined direction, means for converting the advancing web into a continuous tubular body in a first portion of the path including means for securing the marginal portions of the web to each other, and means for subdividing the tubular body into the aforementioned series of discrete tubes including means for exerting upon the tubular body a pull in the predetermined direction in a second portion of the predetermined path downstream of the first portion.

The weakening means can include means for perforating the spaced apart portions of the web, preferably at identical distances from one another as seen in the longitudinal direction of the web. The weakening means can be installed adjacent a third portion of the predetermined path upstream of the first portion.

The subdividing means is preferably provided with or constitutes a means for subdividing the tubular body into tubes having first and second open end portions. Such apparatus can further comprise means for conveying successive tubes of the series of tubes in a second direction (e.g., substantially transversely of the predetermined direction), means for introducing at least one commodity (such as an elongated tampon) into each of the series of tubes through one of the respective end portions while the tubes are being conveyed in the second direction, and means for closing (e.g., sealing) the end portions of the tubes. The closing means can include a first closing unit for the other end portions of the tubes and a second closing unit for the one end portion of each tube. The first closing unit can be located upstream and the second closing unit is located downstream of the introducing means (as seen in the second direction). At least one of the closing units can include means for flattening the respective end portions of the tubes. The conveying means can include a first conveyor (e.g., a drum-shaped conveyor) rotatable about a predetermined axis and having receptacles (e.g., in the form of peripheral flutes) for tubes extending in substantial parallelism with the predetermined axis. The introducing means of such apparatus can include a second conveyor (e.g., a rotary drum-shaped conveyor) which is coaxial with the first conveyor and has commodity-receiving means (e.g., axially parallel peripheral flutes) in register with the receptacles of the first conveyor.

The subdividing means can further include means for moving the tubular body in the predetermined direction at a first speed, and the aforementioned means for exerting upon the tubular body a pull can include means for moving the tubular body in the predetermined direction at a second speed greater than the first speed. The means for moving the tubular body at the second speed is located downstream of the means for moving the tubular body at the first speed (as seen in the predetermined direction). Each of the moving means can include a pair of rolls, and the subdividing means can further comprise means for driving at least one pair of the two pairs of rolls.

The apparatus can further include a source of supply of commodities (e.g., tampons) and means for introducing at least one commodity into each of the tubes downstream of the subdividing means. The source of supply can include a maker of commodities and/or at least one reservoir for commodities.

The apparatus preferably further comprises a source of supply of convoluted web upstream of the advancing means.

The predetermined path is or can be at least substantially horizontal.

The converting means can further comprise a so-called forming rod (e.g., an elongated mandrel) which is adjacent one side of the first portion of the predetermined path and extends in the predetermined direction, and means for draping successive increments of the advancing web around the forming rod so that the marginal portions of the thus deformed web are adjacent to each other; for example, the marginal portions can abut or can overlap one another. If the web is made of or contains a layer of a heat-sealable material or adhesive, the securing means of the converting means can include means (e.g., a so-called sealer of the type known from the field of cigarette making) for thermally or adhesively bonding the marginal portions of the deformed web to each other.

The aforementioned mandrel can constitute a tubular forming member having a plurality of orifices. The converting means of such apparatus further comprises means (e.g., a wrapping mechanism of the type used in cigarette rod making machines) for draping the web around the forming member so that the thus obtained tubular body surrounds at least some of the orifices, and means for admitting into the forming member a pressurized fluid (e.g., slightly compressed air) which issues from the forming member through the orifices and reduces friction between the forming member and the tubular body.

The securing means of the converting means can include means for applying a film of adhesive (e.g., a hot melt) to one side of one marginal portion of the web, and means for folding the marginal portions over each other so that the adhesive film is located between the marginal portions. Such mode of securing the marginal portions of a converted web to each other is customary in many types of cigarette rod making machines (such as those known as PROTOS) and also in many types of filter rod making machines.

In accordance with a presently preferred embodiment, the apparatus is equipped with specially designed means for introducing commodities into successive tubes of the series of tubes. The introducing means comprises a first conveyor (e.g., a large-diameter rotary drum-shaped conveyor) having means (e.g., in the form of axially parallel peripheral flutes) for moving the tubes sideways, a second conveyor (e.g., a large-diameter rotary drum-shaped conveyor) having means (e.g., axially parallel peripheral flutes) for moving commodities in alignment with the tubes on the first conveyor, a pusher (e.g., in the form of a reciprocable plunger or piston) for each moving means of the second conveyor, and cam and follower means for shifting commodities from the second conveyor into the aligned tubes on the first conveyor by acting upon the pushers, i.e., by way of the respective pushers.

A further feature of the invention resides in the provision of a method of converting a running flexible web having two marginal portions and first and second sides into a tubular body. The method comprises the steps of inverting one marginal portion of the running web inside out so that the second side of the inverted marginal portion overlies the second side of an adjacent first intermediate portion of the web, folding the other marginal portion over and beyond the inverted marginal portion to thus convert the web into the tubular body wherein a first part of the other marginal portion abuts the inverted marginal portion and a second part of the other marginal portion is adjacent the second side of a second intermediate portion of the web adjacent the first intermediate portion, affixing the first part of the other marginal portion to the inverted marginal portion, and securing the second part of the other marginal portion to the second intermediate portion. If the web comprises a paper layer at the second side and a heat-sensitive film at the first side, the affixing step can include thermally bonding the first part of the other marginal portion to the inverted marginal portion and the securing step can include thermally bonding the second part of the other marginal portion to the second intermediate portion.

Still another feature of the invention resides in the provision of a method of separating two coherent sections of an elongated tubular body of deformable sheet or web material wherein the sections are connected to each other by a weakened annular portion. The method comprises the steps of advancing the tubular body lengthwise along a predetermined path, depressing two diametrically opposite parts of each section toward each other to at least temporarily convert each of the thus deformed sections at least in part into a bar bell shaped structure with cavities flanking the respective diametrically opposite parts, and pulling one of the deformed sections away from the other section with attendant breakage of the weakened portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 3 is an enlarged transverse sectional view of a tubular body which is a converted multi-layer web and wherein the seam includes a fin seal and an overlap seal;

FIG. 4 is a similar transverse sectional view of a modified tubular body wherein the seam is obtained by adhesively securing the marginal portions of the web to each other;

FIG. 5 is a fragmentary elevational view of a forming rod which can be utilized in the web converting unit of the apparatus shown in FIG. 2;

FIG. 6 is a fragmentary axial sectional view of the structure which is, or which can be, used in the apparatus of FIG. 2 to introduce rod-shaped commodities into discrete tubes;

FIG. 7 is an enlarged transverse sectional view substantially as seen in the direction of arrows from the line VII—VII in FIG. 1;

FIG. 8 is a plan view of an apparatus which constitutes a modification of the apparatus shown in FIG. 2;

FIG. 9 is a view substantially as seen in the direction of arrow IX in FIG. 8; and FIG. 10 is a view substantially as seen in the direction of arrow X in FIG. 8.

DESCRIPTION OF PREFERRED EMBODIMENTS

Figure 1:
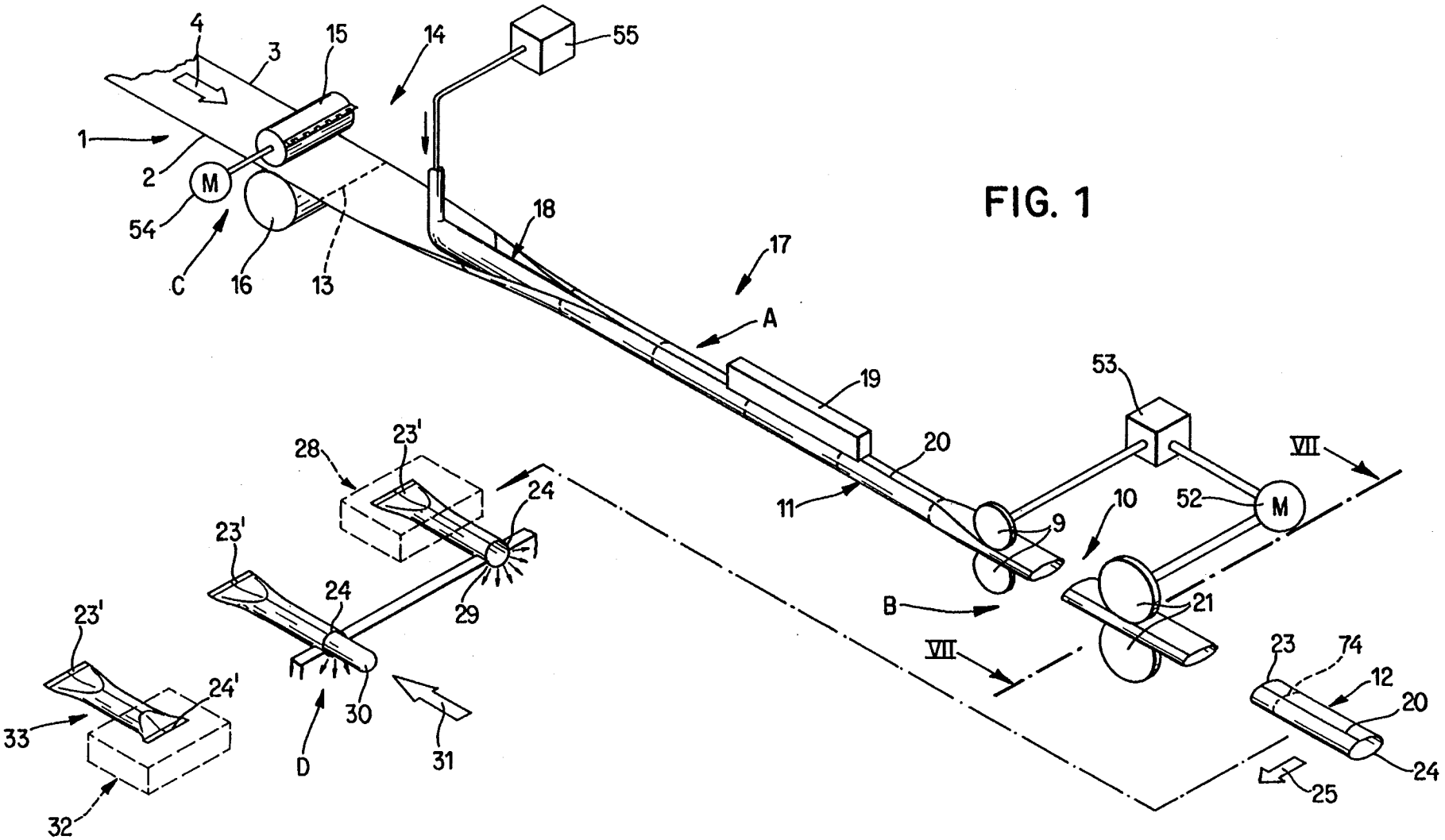
FIG. 1 is a flow diagram showing the progress of the web and of the tubes in an apparatus wherein the tubes receive elongated rod-shaped commodities.

Referring first to FIG. 1, there is shown an elongated web 1 of adhesive-coated, pressure-sensitive and/or heat-sealable material. The web 1 has two spaced apart elongated parallel marginal portions 2, 3 and is advanced longitudinally in the direction of arrow 4 from a source 5 (FIG. 2) by advancing means including pairs of rolls 6 and 7 (FIG. 2) at least one of which is driven, an endless belt conveyor 8 of the type known as garniture, and a pair of rolls 9 at least one of which is driven and which form part of a unit 10 serving to subdivide an elongated continuous tubular body 11 (converted web 1) into a succession of discrete tubes 12 of desired axial length.

Prior to being converted into the tubular body 11, the web 1 is formed with longitudinally spaced apart equidistant transversely extending weakened portions 13, preferably by providing the web with rows of perforations extending at right angles to the direction which is indicated by the arrow 4. A web weakening unit 14 includes a rotary perforating tool 15 at one side and a rotary counterknife 16 at the other side of the path for the web 1 ahead of a converting unit 17 which includes the aforementioned belt conveyor or garniture 8, an elongated forming rod 18 here shown as a hollow tubular mandrel, and a so-called sealer 19 which serves to bond and/or to otherwise secure the marginal portions 2, 3 of the converted web 1 (i.e., of the continuous tubular body 11) to each other. This results in the making of an elongated seam 20 which extends in parallelism with the axis of the tubular body 11 and with the axes of tubes 12 which are obtained by subdividing the body 11 into elongated sections of desired length.

The tool 15 and the counterknife 16 of the web weakening unit 14 are driven in synchronism with the web advancing means including the pairs of rolls 6 and 7, the belt conveyor 8 and the rolls 9 so that the material of the advancing web is not subjected to appreciable tensioning stresses of a magnitude such that the web would break along successive weakened portions 13 at a location upstream of the rolls 9.

The mandrel 18 overlies the upper side of the advancing web 1 between the weakening unit 14 and the rolls 9 and extends in parallelism with the direction (arrow 4) of advancement of the web along its path. The converting unit 17 is adjacent a portion A of the path for the running web 1, the subdividing unit 10 including the rolls 9 and another pair of rolls 21 is adjacent a path portion B downstream of the portion A (as seen in the direction of arrow 4), and the web weakening unit 14 is adjacent a path portion C upstream of the path portion A, i.e., also upstream of the path portion B. It is equally within the purview of the invention to provide the (expiring) bobbin or roll 22 of convoluted web 1 (see the source 5) with transversely extending weakened portions 13 in the form of rows of perforations or the like. All that counts is to ensure that the leader of the tubular body 11 exhibits at least one weakened portion 13 at the time it is engaged by the rolls 21. These rolls constitute a means for exerting upon the leader of the tubular body 11 a pull in the direction of arrow 4 ahead of the foremost weakened portion 13 while the leader of the body 11 is simultaneously engaged by the rolls 9. The rolls 9 engage the tubular body 11 between the two foremost weakened portions 13, and their peripheral speed is less than that of the rolls 21; therefore, the material of the web 1 (actually the material of the tubular body 11) breaks along successive weakened portions 13 and this results in conversion or subdivision of the body 11 into a series of discrete tubes 12 having a predetermined axial length and two open end portions 23, 24. The rolls 21 form part of the aforementioned subdividing unit 10 which further includes the rolls 9 and is located at the portion B of the path for the running web 1 and tubular body 11.

The converting unit 17 is or can be similar to converting units which are used in certain types of cigarette rod making machines (e.g., in machines known as PROTOS produced and distributed by Körber AG, Hamburg, Federal Republic Germany). The unit 17 includes means for draping successive increments of the running web 1 about the mandrel 18 so that the marginal portions 2, 3 approach and merely abut or overlie each other ahead of the sealer 19. The latter applies heat and/or pressure in order to bond the marginal portions 2, 3 to each other and to thus produce the aforementioned axially parallel seam 20. It is equally possible to provide the converting unit 17 with a customary paster which applies a film of adhesive to at least one of the marginal portions 2, 3; the sealer 19 then serves to heat or cool the overlapping marginal portions 2, 3 in order to ensure the establishment of a reliable seam 20. The heating or cooling action of the sealer 19 depends upon the nature of the adhesive.

Figure 2:
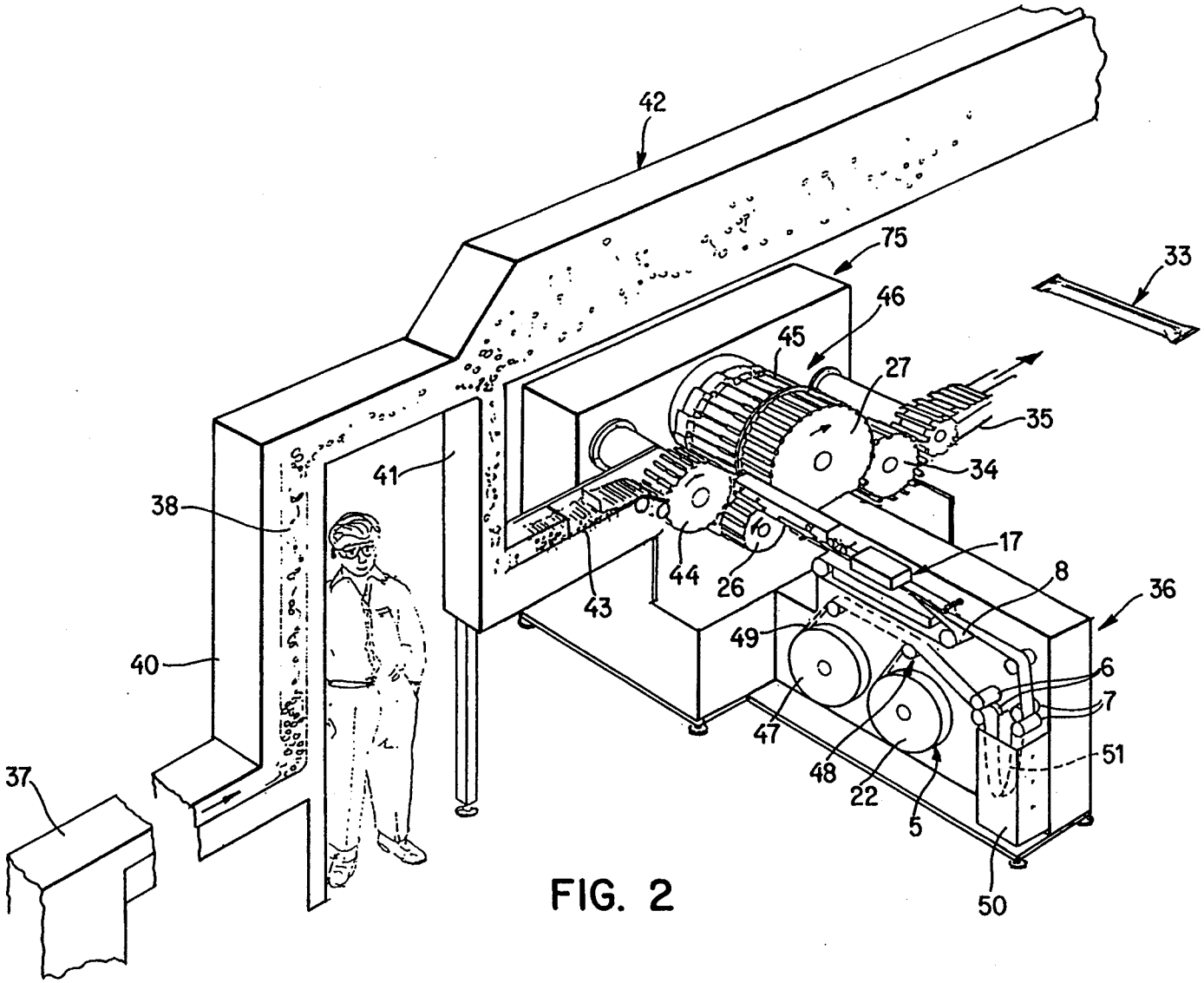
FIG. 2 is a perspective view of an apparatus which can be utilized for the practice of the improved method.

Successive tubes 12 are moved sideways (arrow 25 in FIG. 1) by a rotary drum-shaped conveyor 26 (FIG. 2) having receptacles in the form of axially parallel peripheral flutes wherein the tubes 12 can be attracted by suction in a manner well known from the art of transporting cigarettes or other rod-shaped articles of the tobacco processing industry. The conveyor 26 transfers successive tubes 12 into the axially parallel peripheral flutes of a further rotary drum-shaped conveyor 27 (FIG. 2).

The end portions 23 of successive tubes 12 are closed (e.g., flattened as shown at 23' in FIG. 1) as a result of the application of heat and/or pressure or by resorting to a suitable adhesive. A closing unit is shown schematically in FIG. 1, as at 28 on the conveyor 26; such closing unit can be designed to actually seal the end portions 23 of successive tubes 12 while the tubes advance toward or with the conveyor 26 or with the conveyor 27.

The end portions 24 of successive tubes 12 remain open during advancement toward and with the conveyor 26 as well as (at least) during the initial stage of sidewise movement with the conveyor 27. The reference character 29 denotes in FIG. 1 a unit which serves to restore the shape of the end portions 24 of successive tubes 12 not later than during advancement in the axially parallel peripheral flutes of the conveyor 27. Such restoring of the tubular or cylindrical shape of the end portions 24 of successive tubes 12 might be necessary to counteract the deforming action of the pairs 9 and 21 of rolls forming part of the subdividing unit 10. The end portions 24 should be sufficiently open not later than during advancement with the conveyor 27 because this renders it possible to admit into successive tubes 12 elongated rod-shaped or similar commodities 30, e.g., catamenial tampons. The direction of admission of commodities 30 through the restored or reshaped end portions 24 of successive tubes 12 on the conveyor 27 (e.g., by jets of compressed air) is indicated by arrow 31.

The filled tubes 12 continue to move sideways past a second closing unit 32 which may but need not be identical with the unit 28 and serves to seal the end portions 24 (e.g., by flattening them in a manner as shown at 24' in FIG. 1). The thus obtained finished products 33 are transferred from the peripheral flutes of the conveyor 27 into the peripheral flutes of an intermediate (rotary drum-shaped) conveyor 34 for transfer onto the upper reach of an endless take-off conveyor 35 serving to deliver the products 33 to storage or to a packing or other processing station, not shown, e.g., to a machine similar to that known as COMPAS (produced and distributed by Körber AG).

The heretofore described component parts of the improved apparatus are mounted in or on a frame 36 (FIG. 2) which further carries or is located next to means for supplying the commodities 30 to a station or path portion D downstream of the path portion B. The commodities 30 are turned out by a maker 37, e.g., a tampon making machine of the type known as TAMPOMAT 500 (produced and distributed by the assignee of the present application). The maker 37 delivers a mass flow 38 of parallel commodities 30 in the direction of arrow 39, and the mass flow is confined in a duct 40 serving to discharge into a downwardly extending chute 41 and/or into a reservoir 42, depending on the rate at which the commodities 30 are turned out by the maker 37 and on the rate at which the commodities 30 are confined into discrete tubes 12 to form part of finished products 33. If the apparatus in or on the frame 36 is operated at less than normal speed or is brought to a halt, the commodities 30 are caused to enter the reservoir 42, e.g., a reservoir of the type known as RESY (produced and distributed by Körber AG). Inversely, if the maker 37 is slowed down or is brought to a full stop, the reservoir 42 supplies commodities 30 to the chute 41 for admission to the collating station where the commodities are introduced into discrete tubes 12. The reservoir 42 is of the type known as first-in last-out reservoir; however, it is equally within the purview of the invention to replace the illustrated reservoir 42, or to use such reservoir in combination, with one or more first-in first-out reservoirs of any known design.

That portion of the mass flow 38 of commodities 30 which descends in the chute 41 is caused to advance along a substantially horizontal conveyor system 43 which forms a single layer of commodities 30 and moves them sideways in parallelism with the tubes 12 on the drum-shaped conveyors 26, 27. The conveyor system 43 delivers successive commodities 30 into successive peripheral flutes of a rotary drum-shaped conveyor 44 which, in turn, delivers the commodities 30 into successive axially parallel peripheral flutes of a rotary drum-shaped conveyor 45 by way of a further rotary conveyor **44*a*. The conveyor 45 is coaxial with the conveyor 27 and is provided with or cooperates with means for propelling successive commodities 30 through the open end portions 24 of successive tubes 12 into such tubes ahead of the closing device or unit 32. The conveyors 27 and 45 together constitute a tube filling or commodity introducing unit. All that counts is to ensure that each of the tubes 12 receives at least one commodity 30 which comes to a halt at the closed end portion 23' of the respective tube, and the other end portion 24 of each tube 12 is thereupon closed (e.g., sealed) by the unit 32 to thus complete the conversion of tubes 12 and commodities 30 into finished products 33**.

FIG. 2 further shows a spare bobbin or roll 47 which is installed in or on the frame 36 adjacent the expiring bobbin or roll 22. A splicing device 48 is provided to preferably automatically connect the trailing end of the expired web 1 with the leader of the fresh web 49 on the roll 47 to thus avoid even temporary stoppage of the improved apparatus when the supply of web 1 surrounding the core of the expiring roll 22 is exhausted. Splicers of the type capable of being used in the apparatus of the present invention are known, for example, from the field of cigarette making wherein they serve to connect the trailing ends of expiring webs of cigarette paper, tipping paper or other wrapping material with the leaders of fresh webs. Reference may be had to the aforementioned PROTOS machine of Körber AG.

On its way from the roll 22 to the web converting unit 17, the web 1 advances through a magazine 50 which causes it to form a loop 51 between the pairs of advancing rolls 6 and 7. This reduces the likelihood of undue tensioning (and possible tearing) of the web 1 downstream of the rolls 7 except, of course, under the action of the pairs of rolls 9 and 21 in the subdividing unit 10.

The movements of various mobile (rotary, reciprocatory, etc.) component parts of the improved apparatus can be synchronized in a number of ways. FIG. 2 merely shows a first prime mover 52 which serves to rotate at least one roll of the pair of rolls 21 at a first peripheral speed, a second prime mover 53 which serves to rotate at least one roll of the pair of rolls 9 at a second speed at least slightly less than the first speed, and a third prime mover 54 which serves to drive the perforating tool 15 at a peripheral speed corresponding to that of the rolls 9. The prime mover 52 can include a variable-speed electric motor and the prime mover 53 and/or 54 can constitute a transmission which derives motion from the motor 52 or from another motor, not shown.

The diameters of the coaxial conveyors 27 and 45 are preferably large (i.e., each of these conveyors can carry a relatively large number of tubes 12 (conveyor 27) and commodities 30 (conveyor 45) in order to provide a relatively long interval of time for accurate transfer of commodities into the aligned tubes ahead of the conveyor 34.

One presently preferred type of web includes a strip of paper one side of which is coated with a suitable adhesive. The seam 20 can constitute a so-called fin seal or a so-called overlap seal. It is also possible to design the converting unit 17 in such a way that it produces a fin seal in a first step and thereupon converts the fin seal into an overlap seal.

The mandrel 18 can constitute an elongated pipe or conduit which receives compressed air from a source 55 and discharges streamlets of air into the developing tubular body 11 in order to reduce friction between the mandrel and the material of the web 1.

The introduction of successive commodities 30 into the registering tubes 12 in the flutes of the conveyor 27 can be effected pneumatically, e.g., with jets of compressed air which expel the commodities 30 from the respective flutes of the conveyor 45. Alternatively, or in addition to such mode of introducing, it is often preferred to employ a suitably configurated cam which is tracked by followers provided on plungers which are reciprocable in the flutes of the conveyor 45 in response to rotation of this conveyor about the axis of the conveyor 27. The closed end portions 23' of the tubes 12 then serve as abutments or stops which limit the extent of penetration of commodities 30 into the registering tubes 12 through the still open end portions 24 of such tubes. In this manner, one ensures that each commodity 30 is accurately centered between the two closed end portions 23', 24' of the respective finished product 33. At the present time, the improved apparatus is being designed to turn out between 500 and 1000 finished products 33 per minute.

FIG. 3 shows one presently preferred form of a tubular body 11 which can be obtained as a result of conversion of a web 1 having a paper layer 56 with an uncoated outer side 57 and an inner side 58 coated with a layer or film 59 of heat-sensitive bonding material of any known composition. The marginal portion 2 has been turned inside out so that the corresponding portion of the film 59 is located outside of the corresponding portion of the paper layer 56, and the marginal portion 3 overlies the exposed portion of the film 59. Furthermore, the tip 60 of the marginal portion 3 extends beyond the inverted marginal portion 2 and the film 59 of such tip abuts the outer side of the paper layer 56. The film 59 of the inverted marginal portion 2 is bonded (in response to the application of pressure and/or heat) to the adjacent film 59 of the marginal portion 3 (as at E), and the film 59 of the tip 60 adheres to the adjacent portion of the outer side 57 of the layer 56 (as at F). That portion of the seam 20 which is disposed at E can be said to constitute a fin seal with a flap or fin composed of four layers, namely two layers of film 59 and two layers of paper 56. The other portion of the seam 20 (at F) also includes four layers, namely two layers of paper and two layers of heat-sensitive material. Since the tip 60 is bonded to the outer side 57 of the layer 56, the entire seam 20 can be said to constitute an overlap seal. The direction in which the converting unit 18 folds one-half of the web 1 over the other half to form the fin seal at E and thereupon the overlap seal including the fin seal at E and the remainder of seam 20 at F is indicated by arrow 61.

A web 1 having two layers 56 and 59 is preferred in many instances when the commodities 30 are hygroscopic or should be sealed from moisture in the surrounding area for one or more additional or other reasons. For example, the makers of tampons and/or certain other feminine hygiene products prefer to confine such commodities in fluidtight envelopes. The film 59 not only facilitates the making of a seam 20 of the type shown in FIG. 3 but it also ensures that the web (including the layer 56 and the film 59) is fluidtight in each other region of the finished envelope.

The closing units 28, 32 in an apparatus which treats webs of the type shown in FIG. 3 are or can be equipped with heating elements which serve to bond to each other (by the application of pressure and/or heat) those portions of the film 59 which form part of the respective end portions 23, 24 of a tube 12.

Inversion of the end portion 2 in a manner as shown in FIG. 3 is carried out by a suitably configurated component of the converting unit 17 which folds the web (including the layer 56 and the film 59) while successive increments of such web advance toward the mandrel 18. The properly inverted marginal portion 2 abuts the adjacent (first) intermediate part of the converted web 1, and the tip or second part 60 of the properly folded marginal portion 3 is adjacent a second intermediate part of the web (which, in turn, is adjacent the first intermediate part).

Bonding of the fin seal (shown at E in FIG. 3) to the outer side 57 of the layer 56 (as at F) is desirable and advantageous if the tubes 12 which are obtained as a result of subdivision of a tubular body 11 of the type shown in FIG. 3 are to be transferred from conveyor to conveyor, e.g., from the flutes of the rotary conveyor 26 into the flutes of the rotary conveyor 27 and thence into the flutes of the rotary conveyor 34. The fin would be likely to or could interfere with accurate transfer of such tubes from rotary conveyor to rotary conveyor. Furthermore, the fins could interfere with proper introduction of preselected numbers of finished products 33 into boxes or other types of containers for arrays of such products, for example, into containers for predetermined numbers of feminine hygiene products in predetermined formations (e.g., in so-called quincunx formations or arrays).

Mere flexing of the fin seal (E) against the outer side 57 of the layer 56 (without bonding of the tip 60 to the layer 56 at F) would be unlikely to result in the formation of a permanent overlap seal of the type shown in FIG. 3 because the memory of the layer 56 would tend to move the fin to a position substantially radially of the tubular part of the body 11.

FIG. 4 illustrates a different tubular body 11*a* having a simple seam 20*a*. The web which has been converted into the tubular body 11*a* contained a single layer 56 of paper and the first side of one marginal portion 2 or 3 and/or the second side of the other marginal portion (3 or 2) has been provided with a layer of adhesive (indicated by a legend), e.g., a hot melt or a polyvinyl acetate glue. The sealer 19 of the converting unit 17 was utilized to activate the adhesive film in order to bond the marginal portions 2, 3 to each other and to thus complete the conversion of the web including the paper layer 56 of FIG. 4 into the tubular body 11*a*.

The tubular body 11*a* can be used to yield a series of discrete tubes 12 if the commodities which are to be received in such tubes need not be fully sealed from the surrounding atmosphere. Alternatively, the layer 56 which is shown in FIG. 4 can be made of a material which is impermeable to fluids, i.e., which is impermeable to fluids for reasons other than the application of a film of the type shown at 59 in FIG. 3.

It is clear that a multi-layer web of the type shown in FIG. 3 (i.e., a web having a paper layer 56 and a film 59 of heat-sealable material) can be converted into a tubular body resembling the tubular body 11*a* of FIG. 4. Thus, the film at the inner side of one marginal portion (e.g., 3) of such web can be bonded to the outer side 57 of the layer portion forming part of the other marginal portion (such as 2). This would also result in the making of tubes 12 which are impermeable to fluids even though their layers 56 are not impermeable.

A portion of the forming mandrel 18 is shown in FIG. 5. Such portion is at least partially surrounded by the tubular body 11 or 11*a* and is provided with substantially radially extending orifices or ports 62 which discharge streamlets of air serving to reduce friction between the external surface of the mandrel 18 and the internal surface or inner side of the tubular body. Compressed air which escapes from the mandrel 18 through the orifices 62 is supplied by the aforementioned source 55 and can escape from the tubular body in the direction of the arrow 4 or counter to such direction.

FIG. 6 illustrates a portion of the conveyor 27 forming part of the means for moving the tubes 12 sideways in the direction of arrow 25, and a portion of the conveyor 45 forming part of the unit 46 which is used to introduce discrete commodities 30 into successive tubes 12. The conveyor 27 has axially parallel receptacles 63 in the form of peripheral flutes each of which receives a discrete tube 12 from a similar flute or other receiving means of the conveyor 26 (not shown in FIG. 6). The conveyor 45 has receiving means 64 in the form of axially parallel flutes, e.g., one flute 64 for each flute 63 of the conveyor 27. The axis X—X of the conveyor 27 preferably coincides with the axis of the conveyor 45.

The conveyor 27 is further provided with suction ports 65 which form part of the shaping unit 29 and serve to attract the adjacent end portion 24 of a tube 12 in the respective flute 63. This is desirable and advantageous in order to restore the shape of the end portion 24 of the respective tube 12, namely of the end portion which remained open downstream of the closing unit 28 (and upstream of the closing unit 32) in order to permit introduction of a commodity 30. The commodities 30 are expelled from the flutes 64 into the registering flutes 63 by pushers here shown as plungers 66 having roller followers 67 which track a stationary cam 68 forming part of the introducing unit 46 and being adjacent one axial end of the conveyor 45. The configuration of the cam 68 is such that each commodity 30 penetrates into the aligned tube 12 to a predetermined extent, e.g., into close or immediate proximity of the closed (and preferably sealed) end portion 23' of the respective tube 12. Once the introduction of a commodity 30 into the aligned tube 12 is completed, the latter is advanced past the closing unit 32 which closes (and preferably seals) the respective end portion 24 and converts it into a flattened structure as shown at 24' in FIG. 1. This completes the making of a finished product 33. The closing unit 32 can be installed adjacent the conveyor 45 (downstream of the locus of introduction of commodities 30 into the aligned tubes 12) or next to the intermediate conveyor 34 or take-off conveyor 35.

FIG. 6 further shows that the conveyor 27 is or can be provided with stops in the form of shoulders 69, one in each flute 63. The purpose of the shoulders 69 is to arrest the (still) open end portions 24 at a predetermined distance from the cam 68 to thus ensure that each open end portion 24 is properly positioned relative to the suction ports 65 (to reassume the optimum configuration for convenient introduction of the leader of an elongated rod-shaped commodity 30) as well as to ensure that a fully inserted commodity 30 will move its leader to a position at a desired optimum distance from the then closed and preferably sealed end portion 23' of the respective tube 12.

FIG. 7 illustrates a presently preferred manner in which the rolls 21 of the subdividing unit 10 engage the adjacent increments of the tubular body 11 while the latter is caused to advance in the direction of arrow 4. It will be noted that the peripheral surfaces of the rolls 21 engage two diametrically opposite portions 70, 71 of the tubular body 11 in such a way that the cross-section of the thus deformed body 11 resembles a barbell having two longitudinally extending cavities 72, 73 flanking the pressed-together portions 70 and 71. Such mode of engaging the tubular body 11 reduces the likelihood of excessive deformation and facilitates the task of the suction ports 65 of the shape restoring means 29, i.e., the end portion 24 of each tube 12 can more readily reassume a circular or nearly circular shape for convenient introduction of a rod-shaped commodity 30. The details of the seam 20 are not shown in FIG. 7.

The manner in which the rolls 9 of the means (6–9) for advancing the web 1 and the tubular body 11 in the direction of arrow 4 at a first speed, less than the peripheral speed of the rolls 21, is or can be the same as shown in FIG. 7 for the rolls 21.

FIG. 1 further shows that each tube 12 can be provided with a second circumferentially extending weakened portion 74 which is stronger than a weakened portion 13. The purpose of the weakened portion 74 is to facilitate access to a confined commodity 30 in a finished product 33. Thus, the user simply pulls the closed end portions 23', 24' apart with a force which suffices to break the finished envelope along the weakened portion 74. The strength of the weakened portion 74 should suffice to ensure that such weakened portion is not destroyed while the immediately preceding portion of the tube 12 is engaged and entrained by the rolls 21 and while the immediately following portion of the same tube is simultaneously engaged by the rolls 9.

FIGS. 8, 9 and 10 illustrate certain details of a modified apparatus wherein the frame 36 and a frame 75 for the filling unit 46 are positioned relative to each other in such a way that they together constitute a substantially L-shaped composite frame. This provides room for one or more operators at the location 76, and such operator or operators can inspect and gain access to the units 10, 14, 17 on or in the frame 36 as well as to the filling unit 46 on or in the frame 75.

All such component parts of the apparatus of FIGS. 8 to 10 which are identical with or clearly analogous to corresponding parts of the apparatus of FIG. 2 are denoted by similar reference characters.

As already mentioned above, the maker 37 can be of the type known as TAMPOMAI 500 (produced and distributed by the assignee of the present application).

The manner in which the web 1 can be supplied from the source 5 to the converting unit 17 and in which the web can be converted into a tubular body 11 at the unit 17 is or can be similar to the manner of manipulating webs of cigarette paper or other strip-shaped wrapping material in certain types of machines for the making and/or processing of rod-shaped articles of the tobacco processing industry. Reference may be had, for example, to U.S. Pat. No. 4,893,640 granted Jan. 16, 1990 to Heitmann et al. for "Multiple-rod cigarette making machine" (owned by Körber AG of Hamburg, Federal Republic Germany), to aforementioned cigarette makers of the type known as PROTOS (produced and distributed by Körber AG), as well as to U.S. Pat. No. 3,974,007 granted Aug. 10, 1976 to Greve for "Method and apparatus for the production of filter rod sections" (owned by Körber AG). Reference may also be had to U.S. Pat. No. 4,901,860 granted Feb. 20, 1990 to Wahle et al. for "Apparatus for testing and classifying cigarettes or the like" (owned by Körber AG) which describes and shows a filter tipping machine of the aforementioned type known as MAX. The disclosures of the above enumerated patents are incorporated herein by reference. Such patents describe and show numerous details of means for converting a running web of flexible material into a tubular body as well as numerous details of means for transporting rod-shaped articles axially and/or sideways. Reference may also be had to U.S. Pat. No. 4,339,026 granted Jul. 13, 1982 to Bäse et al. and describing and showing certain reservoirs of the type suitable for use in or with the apparatus of the present invention, e.g., for temporary storage of tubes 12, commodities 30 or finished products 33. The disclosure of Bäse et al. is also incorporated hereby by reference. This patent discloses certain reservoirs of the aforementioned type known as RESY.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

We claim:

1. A method of transforming an elongated flexible web having two longitudinally extending marginal portions into a succession of discrete tubes each having spaced-apart first and second end portions, comprising the steps of weakening a plurality of longitudinally spaced-apart substantially transversely extending portions of the web; advancing the web lengthwise along a predetermined path in a predetermined direction; converting the advancing web into a continuous tubular body in a first portion of said path, including securing the marginal portions of the web to each other; subdividing the tubular body into a succession of discrete tubes, including exerting upon the tubular body a pull in said direction in a second portion of said path to break the advancing tubular body along the weakened portions thereof; closing one end portion of each of said succession of discrete tubes downstream of said second portion of said path; and introducing commodities into successive discrete tubes downstream of said second portion of said path upon completion of said closing step.

2. The method of claim 1, wherein said weakening step is carried out in at least one third portion of said path upstream of said second portion.

3. The method of claim 1, wherein said weakening step is carried out in at least one third portion of said path upstream of said first portion.

4. The method of claim 1, wherein said weakening step includes perforating the longitudinally spaced apart portions of the web.

5. The method of claim 1, wherein said introducing step includes introducing commodities through the other end portions of said succession of tubes, and further comprising the step of closing the other end portions upon completion of said introducing step.

6. The method of claim 1, wherein said introducing step comprises introducing elongated substantially rod-shaped commodities.

7. The method of claim 6, wherein the commodities are feminine hygiene products.

8. The method of claim 1, wherein the elongated web comprises a heat-sealable flexible material and said converting step includes bonding the marginal portions of the web to each other.

9. The method of claim 1, further comprising the step of moving successive tubes sidewise substantially transversely of said predetermined direction downstream of said second portion of said path.

10. The method of claim 9, wherein said introducing step includes at least partially filling successive tubes with commodities during sidewise movement thereof.

11. The method of claim 10, further comprising the step of closing the other end portion of each tube upon completion of said introducing step.

12. The method of claim 11, wherein at least one of said closing steps comprises flattening the respective end portions of the tubes.

13. The method of claim 1, wherein said subdividing step includes partially flattening longitudinally spaced-apart portions of the tubular body.

14. The method of claim 1, wherein said securing step includes fluidtightly connecting the marginal portions of the web to each other.

15. The method of claim 1, wherein the web has a first side and a second side and the first and second sides of the converted web are respectively an inner side and an outer side of the tubular body, said securing step including bonding the first sides of the marginal portions to each other to form a fin, and bonding the fin to the outer side of the tubular body.

16. The method of claim 1, wherein the web has a first side and a second side and said securing step includes applying a film of adhesive to the first side of one of said marginal portions and bonding the second side of the other of said marginal portions to the first side of the one marginal portion.

17. The method of claim 1, wherein the first side of the web is provided with a fluid-impermeable layer of heat-sealable material and the first and second sides of the converted web are respectively an inner side and an outer side of the tubular body, said securing step including heat sealing the first side of one of said marginal portions to the second side of the other of said marginal portions.

18. The method of claim 1, further comprising the steps of establishing and maintaining a source of convoluted web in a further portion of said path upstream of said first portion, said advancing step including drawing the web from said source and further comprising the step of looping the web between the source and the first portion of said path.

19. Apparatus for transforming an elongated flexible web having two longitudinally extending marginal portions into a series of discrete tubes each having spaced-apart first and second end portions, comprising means for weakening a plurality of longitudinally spaced-apart substantially transversely extending portions of the elongated web; means for advancing the web lengthwise along a predetermined path in a predetermined direction; means for converting the advancing web into a continuous tubular body in a first portion of said path, including means for securing the marginal portions to each other; means for subdividing the tubular body into the series of discrete tubes, including means for exerting upon the tubular body a pull in said direction in a second portion of said path downstream of said first portion; means for closing one end portion of each of said series of discrete tubes; and means for introducing at least one commodity through the other end portion and into each of said series of tubes upon closing of the one end portion.

20. The apparatus of claim 19, wherein said weakening means comprises means for perforating the web.

21. The apparatus of claim 19, wherein said weakening means is adjacent a third portion of said path upstream of said first portion.

22. The apparatus of claim 19, further comprising means for conveying successive tubes of the series in a second direction substantially transversely of said predetermined direction, said means for introducing including means for introducing commodities while the tubes are being conveyed in said second direction, and further comprising means for closing the other end portions of the tubes upon completed introduction of commodities.

23. The apparatus of claim 22, wherein said closing means comprise a first closing unit for the one end portion of each tube of said successive tubes and a second closing unit for the other end portion of each tube, said first closing unit being located ahead of said second closing unit and said second closing unit being located downstream of said introducing means as seen in said second direction.

24. The apparatus of claim 23, wherein at least one of said closing units comprises means for flattening the respective end portions of the tubes.

25. The apparatus of claim 22, wherein said conveying means includes a first conveyor rotatable about a predetermined axis and having receptacles for tubes extending in substantial parallelism with said axis, said introducing means including a second rotary conveyor coaxial with said first conveyor and having commodity receiving means in register with the receptacles of said first conveyor.

26. The apparatus of claim 19, wherein said subdividing means further includes means for moving the tubular body in said predetermined direction at a first speed and said means for exerting a pull includes means for moving the tubular body in said predetermined direction at a second speed greater than said first speed, said means for moving at said second speed being disposed downstream of said means for moving at said first speed, as seen in said predetermined direction.

27. The apparatus of claim 26, wherein each of said moving means includes a pair of rolls and said subdividing means further comprises means for driving at least one pair of said rolls.

28. The apparatus of claim 19, further comprising a source of supply of commodities and means for introducing at least one commodity into each of the tubes downstream of said subdividing means.

29. The apparatus of claim 28, wherein said source of supply includes a maker of commodities.

30. The apparatus of claim 28, wherein said source includes a reservoir for commodities.

31. The apparatus of claim 19, further comprising a source of supply of convoluted web upstream of said advancing means.

32. The apparatus of claim 19, wherein said path is at least substantially horizontal.

33. The apparatus of claim 19, wherein said converting means further comprises an elongated mandrel adjacent one side of said first portion of said path and extending in said direction, and means for draping the advancing web around said mandrel so that the marginal portions of the draped web are adjacent each other.

34. The apparatus of claim 19, wherein the web contains a heat-sealable material and said securing means includes means for thermally bonding the marginal portions of the web to each other.

35. The apparatus of claim 19, wherein said converting means further comprises a tubular forming member having a plurality of orifices, means for draping the web around the forming member so that the thus obtained tubular body surrounds at least some of said orifices, and means for admitting into said forming member a pressurized fluid which issues from the forming member through said orifices to reduce friction between the forming member and the tubular body.

36. The apparatus of claim 19, wherein said securing means includes means for applying a film of adhesive to one side of one marginal portion of the web, and means for folding the marginal portions over each other so that the adhesive film is located between the marginal portions.

37. The apparatus of claim 19, wherein said introducing means includes a first conveyor having means for moving the tubes sideways, a second conveyor having means for moving commodities in alignment with the tubes on the first conveyor, a pusher for each moving means of said second conveyor, and cam and follower means for shifting commodities from the second conveyor into the aligned tubes on the first conveyor by way of the respective pushers.

38. A method of converting a running web having two marginal portions and first and second sides into a tubular body, comprising the steps of inverting one marginal portion of the running web inside out so that the second side of the inverted marginal portion overlies the second side of an adjacent first intermediate portion of the web; folding the other marginal portion over and beyond the inverted marginal portion to thus convert the web into said tubular body wherein a first part of the other marginal portion abuts the inverted marginal portion and a second part of the other marginal portion is adjacent the second side of a second intermediate portion of the web adjacent the first intermediate portion; affixing the first part of the other marginal portion to the inverted marginal portion; and securing the second part of the other marginal portion to the second intermediate portion.

39. The method of claim 38, wherein the web has a paper layer at the second side and a heat-sensitive film at the first side and said affixing step includes thermally bonding the first part of the other marginal portion to the inverted one marginal portion, said securing step including thermally bonding the second part of the other marginal portion to the second intermediate portion.

40. A method of separating two coherent sections of an elongated tubular body of deformable sheet material wherein the sections are connected to each other by a weakened annular portion, comprising the steps of advancing the tubular body lengthwise along a predetermined path; depressing two diametrically opposite parts of each section toward each other to at least temporarily convert each of the thus deformed sections at least in part into a barbell shaped structure with cavities flanking the respective diametrically opposite parts; and pulling one of the deformed sections away from the other section with attendant breakage of the weakened portion.

* * * * *